US005742315A

United States Patent [19]

Szlucha et al.

[11] Patent Number: 5,742,315

[45] Date of Patent: Apr. 21, 1998

[54] SEGMENTED FLEXIBLE HEATER FOR DRYING A PRINTED IMAGE

[75] Inventors: Thomas F. Szlucha; John H. Looney, both of Fairport, N.Y.

[73] Assignee: Xerox Corporation, Stamford, Conn.

[21] Appl. No.: 523,322

[22] Filed: Sep. 5, 1995

[51] Int. Cl.[6] ..... B41J 2/01

[52] U.S. Cl. ..... 347/102; 347/101

[58] Field of Search ..... 347/102, 101

[56] References Cited

U.S. PATENT DOCUMENTS

| | | | |
|---|---|---|---|
| 4,982,207 | 1/1991 | Tunmor et al. | 346/138 |
| 5,005,025 | 4/1991 | Miyakawa et al. | 346/25 |
| 5,406,321 | 4/1995 | Schwiebert et al. | 347/102 |

FOREIGN PATENT DOCUMENTS

| | | | |
|---|---|---|---|
| 62-13536 | 6/1987 | Japan | 347/102 |
| 63-30604 | 12/1988 | Japan | 347/102 |

*Primary Examiner*—Valerie Lund
*Attorney, Agent, or Firm*—Daniel J. Krieger

[57] ABSTRACT

A segmented flexible heater disposed adjacently to a paper path in a printing machine for heating a recording medium before printing and during printing. The segmented flexible heater includes a curved first portion for preheating the paper and a substantially planar second portion for heating the paper in a print zone wherein the second portion generates heat energy having a temperature greater than the heat energy generated by the first portion. The first portion includes apertures for accommodating drive rollers for moving the recording medium into the print zone area heated by the second portion. The apertures in the flexible heater provide for continuous heating of the recording medium before and during heating. The second portion is preferably at least two printing swaths wide to prevent thermal shock to the portion of the printing medium being printed on.

15 Claims, 4 Drawing Sheets

SEGMENTED FLEXIBLE HEATER FOR DRYING A PRINTED IMAGE

FIELD OF THE INVENTION

This invention relates generally to a printing machine and more particularly to drying ink deposited on a recording medium by a liquid ink printer.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks and particularly those used in thermal ink jet printing, include a colorant or dye and a liquid which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning of the recording medium typically prepares the recording medium for receiving ink by driving out excess moisture which can be present in a recording medium such as paper. Not only does this preconditioning step reduce the amount of time necessary to dry the ink once deposited on the recording medium, but this step also improves image quality by reducing paper cockle and curl which can result from too much moisture remaining in the recording medium.

Various drying mechanisms for drying images deposited on recording mediums are illustrated and described in the following disclosures which may be relevant to certain aspects of the present invention.

In U.S. Pat. No. 4,982,207, to Tunmore et al., a heater construction for an ink jet printer having a rotary print platen for holding and transporting a print sheet through a print path is described. The platen heater includes a hollow shell having vacuum holes for sheet attachment. A heating foil is detachably mounted in a heat transfer relation with the interior periphery of the shell.

U.S. Pat. No. 5,005,025, to Miyakawa et al., describes an ink jet recording apparatus for recording which fixes ink through evaporation of an ink solvent. The apparatus includes a heating member extending both upstream and downstream with respect to a recording area and a conveying direction of the recording sheet. The heating member contacts the recording sheet to assist in the fixation of the ink.

U.S. Pat. No. 5,406,321, to Schwiebert et al., describes an ink jet printer and a paper preconditioning preheater therefore. The paper preconditioning preheater has a curved surface and a multi-purpose paper path component to accomplish direction reversal for the paper. The paper contacts the preheater which dries and shrinks the paper to condition it for a printing operation. The preheater is a thin flexible film carrying heater elements which is suspended in air to provide extremely low thermal mass and eliminate the need for long warm up times.

SUMMARY OF THE INVENTION

In accordance with one aspect of the present invention, there is provided a printing machine for printing on a recording medium moving along a path through a print zone. The printing machine includes a printhead adapted to deposit ink on the recording medium and a segmented flexible heater. The segmented flexible heater is disposed adjacently to the path, for heating the recording medium, and includes a first portion defining a first heat region for preheating the recording medium and a second portion defining a second heat region for heating the recording medium in the print zone.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
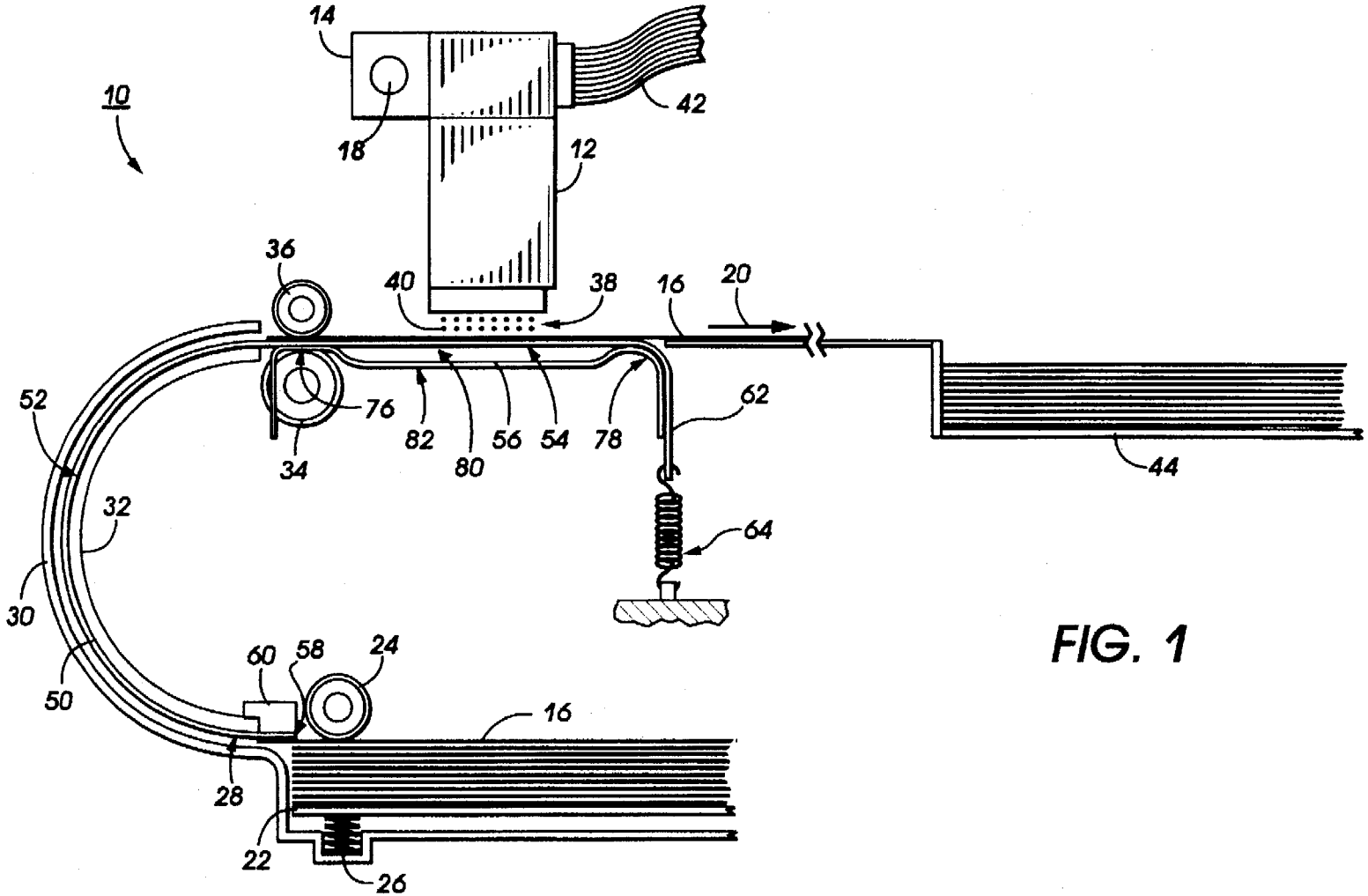
FIG. 1 is a schematic elevational side view of an ink jet printer of the present invention.

Although the present invention discussed herein may be used for drying any image which is created by a liquid ink printer, the description of the present invention will be described in the environment of an ink jet printer such as that shown in FIG. 1. FIG. 1 illustrates a schematic representation of a thermal ink jet printer 10 in a side elevation view. A translating ink jet printhead 12 printing black and/or colored inks is supported by a carriage 14 which moves back and forth across a recording medium 16, for instance, sheets of paper or transparencies, on a guide rail 18. Multiple printheads printing different colors are also within the scope of this invention. The recording medium 16 is moved along a recording medium path 20 through the printer in the direction noted by the arrow 20. Single sheets of the recording medium 16 are fed from a tray 22 by a document feed roll 24. The document tray 22 is spring biased by a biasing mechanism 26 which forces the top sheet of the stack of recording sheets held by the tray 22 into contact with the feed roll 24. A top recording medium 16 in contact with the drive roll 24 is transported by the drive roll 24 into a chute 28 which is defined by an outer guide member 30 spaced from an inner guide member 32, each of which are curved to thereby reverse the direction of the recording sheets 16 for printing by the printhead 12. Once the recording medium exits the chute 28, the recording medium 16 is driven into the nip of a drive roll 34 cooperating with a pinch roll 36 to advance the recording sheet 16 into a print zone 38.

The print zone 38 is the area directly beneath the printhead 12 where droplets of ink 40 are deposited by an array of ink nozzles printing a swath of information and arranged on a front face of the printhead. The front face of the printhead is substantially parallel to the recording medium. The carriage 14, traveling orthogonally to the recording medium 16, deposits the ink droplets 40 upon the recording medium 16 in an imagewise fashion. The printhead 12 receives ink from either an attached ink tank or from an ink supply tube (not shown). The image deposited upon the recording medium 16 can include text and/or graphic images, the creation of which is controlled by a controller, known to those skilled in the art, in response to electrical signals traveling through a ribbon cable 42 coupled to the printhead 12. Before the recording medium 16 has completely left control of the drive roll 34 and the pinch roll 36, an exit drive roll/pinch roll combination (not shown) or other known means captures the leading edge of the recording medium 16 for transport to an output tray 44 which holds printed recording medium.

To fix the liquid ink to the recording medium 16, the moisture must be driven therefrom. While it is possible to dry the ink by natural air drying, natural air drying can create certain problems such as cockle or curl and can also reduce the printing throughput of the printer. Consequently, active drying by the application of heat energy to the printed recording medium is preferred. To improve printing quality, the present invention includes a segmented flexible heater 50 which is located along the inside of the chute 28, in contact with and supported by the inner guide section 32, and which extends through the print zone 38. The segmented flexible heater 50 is located within the printer 10 such that the side of the recording medium opposite the side to be printed comes into direct contact with the flexible heater. Heat energy is delivered primarily through conduction. The inner guide section 32 can include apertures, such as round holes, diagonally placed slots, or raised areas to thereby shorten warm-up times.

The segmented flexible heater 50 is arranged within the printer 10 such that a first preheat area 52 is defined to preheat the paper before it enters the print zone area 38. A second heat area 54 is defined in the print zone 38 to thereby apply heat energy to the backside of the recording medium 16 during printing. As can be seen in FIG. 1, the portion of the flexible heater 50 located within the print zone 38 is substantially flat thereby providing a substantially flat uniform contact surface for supporting the recording medium in the print zone 38 during printing. Surface flatness is required to insure adequate paper to heater contact as well as to maintain the critical spacing between the printhead 12 and the recording medium.

To adequately maintain the flatness of the flexible heater within the preheat zone 52 and the heat zone 54, the flexible heater 50 is supported by a print zone area heater support 56. A first end 58 of the flexible heater 50 is attached to a mounting member 60 which, in turn, is mounted to the inner guide member 32. A second end 62 of the flexible heater 50 has attached thereto a spring or tensioning mechanism 64 (here schematically represented) for applying tension to the flexible heater.

The tensioning mechanism 64 not only maintains the necessary surface flatness in the print zone 38, but also maintains the critical spacing between the printhead 12 and the recording medium. By stretching the flexible heater 50, the heater is placed in tension to reduce or eliminate buckling or unevenness which can result from thermal expansion that takes place when the flexible heater is activated.

Figure 2:
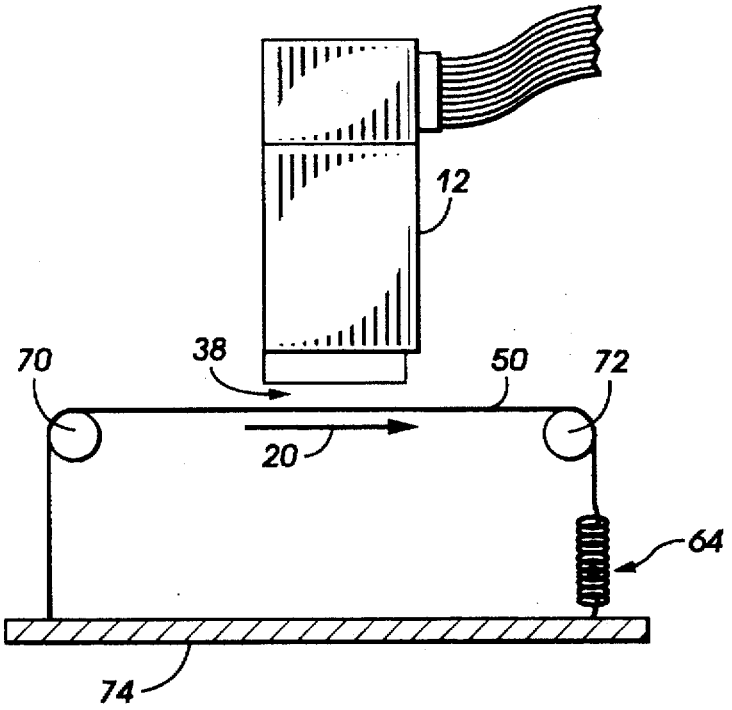
FIG. 2 is a schematic elevational view of a ink jet printhead, a segmented flexible heater, and a structural support therefore.

Conceptually, the mechanism for maintaining the sheet flatness within the print zone is illustrated in FIG. 2. The flexible heater 50 is placed under tension by the tension mechanism 64 which stretches the flexible heater over a first strut 70 and a second strut 72 positioned perpendicular to the process direction 20 and which are parallel with respect to one another. The first strut 70 and the second strut 72 are positioned at either side of the print zone 38 and run across the width of the flexible heater 50. The flexible heater 50 is pulled to tension in the dimension perpendicular to each of these support surfaces. Since the flexible heater 50 is not physically attached to the surface of the first strut 70 or second strut 72, the heater is free to expand and to contract without creating buckling or corrugation of the heater. The heater 50 has the end opposite the tensioning member attached to a rigid member 74, or for instance, the frame of the printer.

Returning to FIG. 1, the print zone support 56 incorporates the features illustrated in FIG. 2 for tensioning the flexible heater 50. The support 56 includes a first portion 76 corresponding to the first strut 70 and a second portion 78 corresponding to the second strut 72. The so called "struts" in the present invention are simply elevated sections of a plastic extrusion that run the width of the print zone from one side of the frame to the other. The flexible heater 50 thereby contacts accurately controlled parallel regions of the support 56 at or before and after end of the print zone 38 to form a flat contact surface. In addition to forming a flat contact surface within the print zone 38, the flexible heater defines a gap 80 between the bottom surface of the flexible heater and a third portion 82 of the support 56 which extends between the first portion 76 and the second portion 78. The gap 80 extends across and beneath the entire width of the recording medium being printed. This gap not only maintains the flatness of the flexible heater within the print zone since the support member 56 does not contact the tensioned flexible heater at this location, but also improves the overall heating efficiency and minimizes the warm-up time of the heater.

Figure 3:
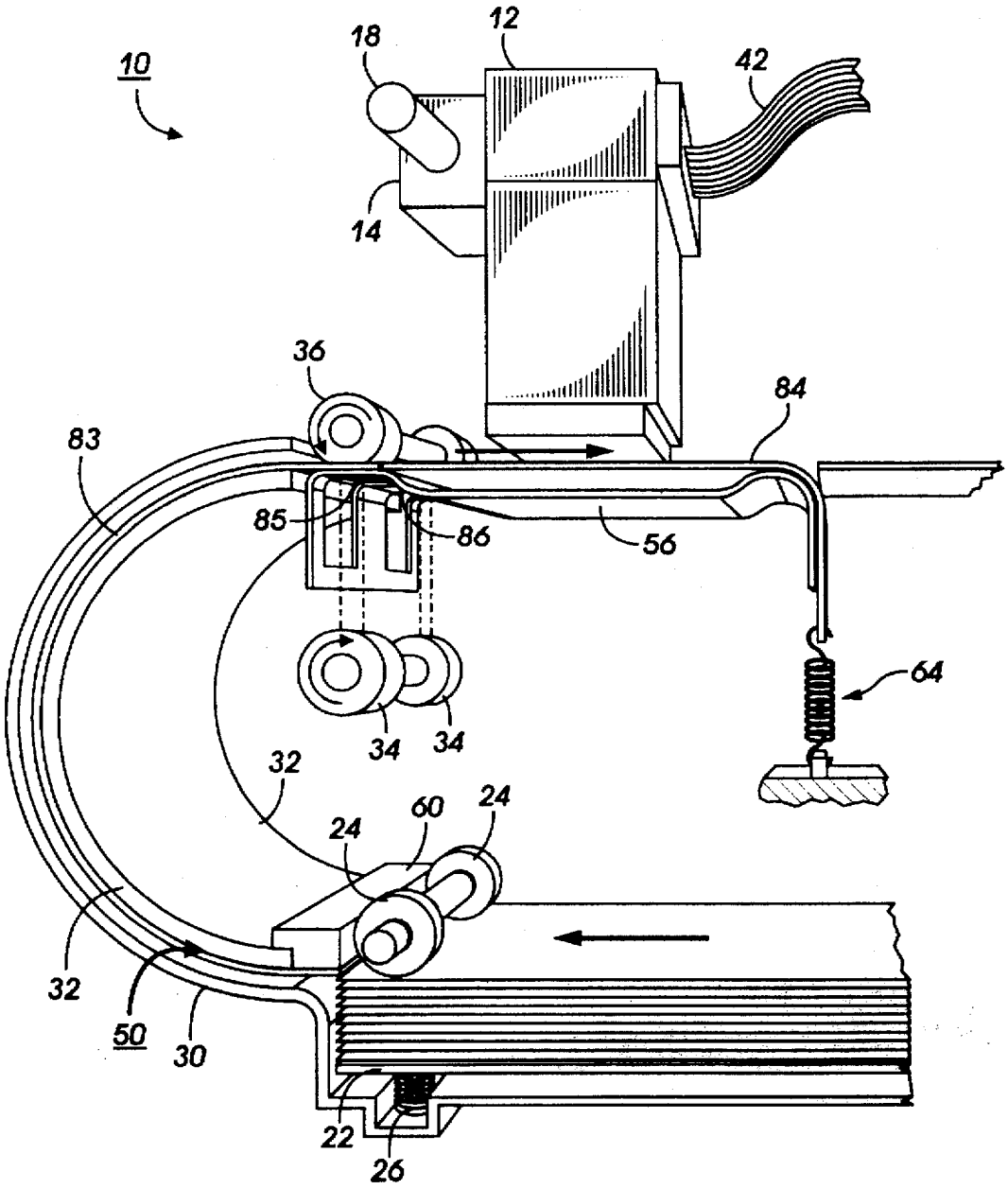
FIG. 3 is a fragmentary perspective view of the ink jet printer of FIG. 1.

FIG. 3 is a partial schematic perspective view of the printer 10 for illustrating additional features of the heater 50. The segmented heater 50 includes a first portion 83, corresponding to the first preheat area 50 of FIG. 1, and a second portion 84, corresponding to the second heat area 54 of FIG. 1. The first portion 83 is supported by the inner guide member 32 which creates a curved heating surface used to preheat the recording medium during passage through the chute 28 of FIG. 1. The first portion 83 preheats the recording medium and is primarily necessary when printing on stress papers, since the absorption and desorption of water relaxes the internal stresses of the paper and can result in deformation, such as cockle. The preheating removes excess moisture from the paper and results in a more dimensionally stable sheet as well as improving ink absorption into the paper. Transparencies and certain coated papers do not require preheating and, in fact, can be damaged by excess preheating because of softening. The preheat area 83 is, therefore, separately controllable and can either be turned off or can have the heat produced thereby significantly reduced when these type of media are being printed.

The second portion 84 of the flexible heater 50 generates heat energy having a temperature greater than the first portion 83. The second portion 84 provides the primary drying function for driving the liquid from the ink deposited by the printhead in the print zone. As can be seen, the distance travelled by the recording medium over the second portion 84 is much less than the distance travelled by the recording medium over the first portion 83. The long dwell time experienced by a recording medium in the first portion 83 drives any excess moisture from the paper. The function of the second portion 84 is primarily to add heat energy to the recording medium while printing to draw excess liquid from the ink. According to the present invention, therefore, a short dwell time of high heat energy follows a long dwell time of low heat energy thereby providing accurately controlled drying for all types of recording medium.

The first portion 83 of the flexible heater 50 includes a first aperture 85 and a second aperture 86. The first aperture 85, as well as the second aperture 86, provide for the continued advancement of the recording medium through the print zone by enabling contact of the pinch roller to the drive roller for picking up the lead edge of the recording medium.

By providing apertures for accommodating the pinch roll and drive rolls, the amount of heat area provided by the present invention for a preheat zone is increased for the present printer configuration, since an area between the rollers and the print zone heating area can still be heated.

Figure 4:
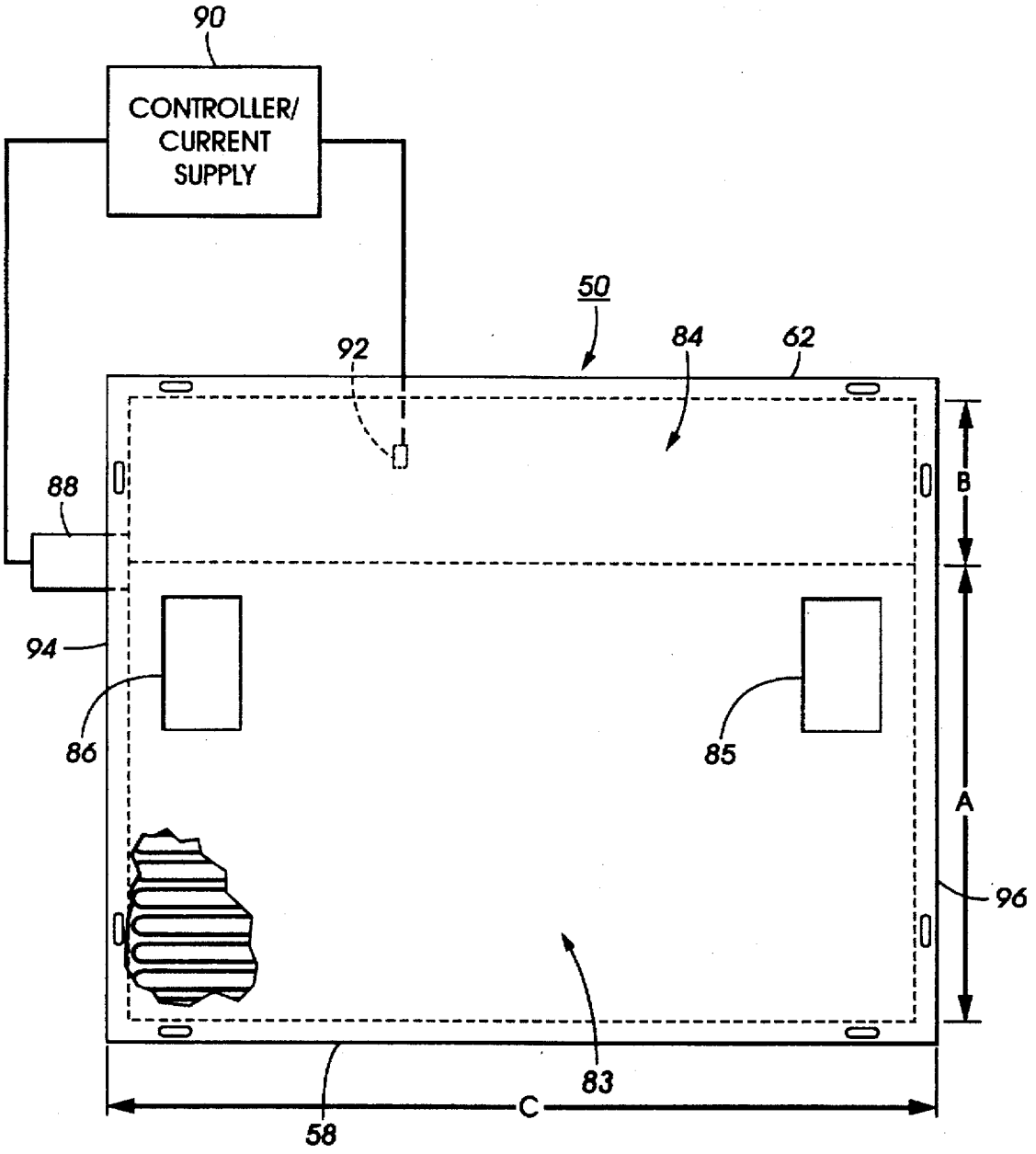
FIG. 4 is a plan view of a segmented flexible heater used in the FIG. 1 ink jet printer.

FIG. 4 illustrates the two segment flexible heater 50 of the present invention. The construction of the flexible heater 50 consists of thin circuit wire runs of NiChrome resistive heat generating material. The thin layer is sandwiched between a top and a bottom layer of heat resistant polymer such as Kapton(polyimide) or polyester. The selection of materials is based primarily on the operating temperature of the heater.

Portions of the heater are organized to supply heat energy according to specific voltages and watt densities. The thin configuration, for instance, preferably having a thickness of less than one-tenth of an inch, allows the heater to follow the radius of the preheat section. Since, the core of the heater must be thin, for instance, less than 0.001 inch, serpentine shaped NiChrome elements perform well. Orientation of the heat runs in the construction are parallel to the motion of the printhead and perpendicular to the paper motion. The layer sandwiching the NiChrome element provides support for the heater core. The choice of sandwiching materials is primarily driven by the operating temperatures. Kapton (polyimide) is used for high operating temperatures, for instance, greater than 300° F. Polyester, on the other hand, can be used for lower operating temperatures, for instance, approximately 200° F. The overall thickness of this construction is less than 0.005 inches and being made primarily of a plastic, the heater is very flexible.

The described flexible heater is also known as a foil heater. Other types of flexible heaters, however, are within the scope of the present invention. For instance, any flexible heater having a low thermal mass is acceptable, such as wire resistive elements traversing a support medium, carbon loaded film, metal film photopatterned with runs of graphite material, or conductive material sprayed or doctor bladed on a support medium.

Attached to the heater 50 is a connecting member 88 which includes electrical connecting leads for connecting to the first portion 83 and the second portion 84. Since the first portion 83 generates heat energy for preheating the paper, a current is applied to the first portion 83 by a controller/current supply module 90. The current applied to the first portion 83 is set to a predetermined level such that the heat energy generated by the first portion 83 is approximately 2.5 watts per square inch. The temperature of this region is not sensed, and consequently, there are no feedback signals for maintaining the temperature of the heat generated by the first portion 83. This portion, however, could include temperature sensing. The second portion 84, on the other hand, includes an embedded thermistor 92 for sensing the temperature of the second portion 84. The embedded thermistor 92 is connected to the controller/current supply 90 which receives electrical signals indicating temperature. A current control signal is returned to the second portion 84 through the connecting member 88.

The electrical signals received from the thermistor indicate the sensed temperature and help maintain the temperature of the second portion 84 at approximately 50–75 degrees Fahrenheit hotter than the temperature of the first portion 83. The heat energy generated by the second region 84 is approximately 5 watts per square inch.

A linear distance A of the first first portion 83 in the paper path direction is approximately 2.5 inches. A linear distance B of the second portion 84 in the paper path direction is approximately 1 inch. Other distances are possible depending on swath width, paper length, heating temperatures, and other know factors affecting drying. Ideally, the second portion 84 is at least twice as wide as the distance covered by the printhead printing a single swath of information perpendicular to the paper path direction. By making the second portion 84 one swath wider than the amount of area covered by the printhead, the ink deposited by the printhead does not experience thermal shock during printing which could occur when transitioning from one print area to the next. The one swath advance print zone located before the actual print zone of the printhead provides for a more accurately controllable heat energy presence on the recording medium. A linear distance C is sufficiently wide to adequately heat the width of the paper deposited with ink.

While the embodiments of FIGS. 1, 2 and 3 have illustrated anchoring the flexible heater at the edge 58 and applying tension to the edge 62, it is also possible to apply tension to all four edges of the flexible heater. Consequently, spring loaded mechanisms could be applied not only the second end 62, but also to the first end 58, to a first side edge 94 and a second side edge 96. These edges could include perforations as shown for attaching spring loaded devices thereto.

In recapitulation, there has been described a segmented flexible heater for drying a printed image on a recording medium moving along a paper path. The segmented flexible heater is disposed adjacently to the paper path and includes a first portion for preheating the paper and a second portion for heating a portion of the paper located within a print zone. It is therefore apparent that there has been provided in accordance with the present invention a segmented flexible dryer that satisfies the aims and advantages hereinbefore set forth. While this invention has been described in conjunction with the specific embodiment thereof, it is evident that many alternatives, modifications and variations will be apparent to those skilled in the art. For instance, a segmented flexible heater is not limited to having two portions but can include any number of portions greater than two. Likewise, the temperature selected for the preheat portion and the print area portion can be selected as a function of print mode and media type. For example, a reduced temperature setpoint could be used for non-paper backed transparencies. In another instance, a higher temperature setpoint and improved intercolor bleed performance could be achieved in a high quality print mode which utilizes multi-pass printing where the image is built in two or more passes. These temperature setpoints would be optimized for the particular ink being used. Accordingly, it is intended to embrace all such alternatives, modifications and variations that fall within the spirit and broad scope of the appended claims.

What is claimed is:

1. A printing machine for printing on a recording medium moving along a path through a print zone, comprising:

a printhead, adapted to deposit ink on the recording medium; and a segmented flexible heater, disposed adjacently to the path, for heating the recording medium, including a first portion defining a first heat region preheating the recording medium and a second portion defining a second heat region heating the recording medium in the print zone wherein said first portion generates heat energy having a first temperature and said second portion generates heat energy having a second temperature greater than the first temperature.

2. The printing machine of claim 1, wherein said first portion is located along the path before said second portion in the direction of movement of the recording medium.

3. The printing machine of claim 2, wherein said second portion of said segmented flexible heater is aligned with the print zone.

4. The printing machine of claim 1, further comprising a drive roller, said segmented flexible heater including an aperture to permit said drive roller to contact the recording medium thereby advancing the recording medium along the path.

5. The printing machine of claim 4, further comprising a temperature controller, coupled to said second portion, controlling the heat energy generated by said second portion.

6. The printing machine of claim 5, wherein said said second portion includes a temperature sensing device, coupled to said temperature controller, sensing the temperature of said second portion.

7. The printing machine of claim 6, wherein said temperature controller controls the temperature of the second heat region according to signals received from said temperature sensing device.

8. The printing machine of claim 7, wherein said temperature sensing device comprises a thermistor.

9. The printing machine of claim 7, further comprising a current source coupled to said first portion, supplying a predetermined current thereto to generate heat energy.

10. The printing machine of claim 9, wherein said current source is coupled to said second region, supplying current thereto according to the sensed temperature of said second portion.

11. The printing machine of claim 2, further comprising a heater support supporting said segmented flexible heater adjacently to the path.

12. The printing machine of claim 11, further comprising a tensioning member, coupled to said segmented flexible heater, placing said segmented flexible heater in tension across said heater support.

13. The printing machine of claim 12, wherein said heater support includes a first support member and a second support member, said second support member being spaced a distance from said second support member, said first support member and said second support member contacting said segmented flexible heater.

14. A printing machine for printing on a recording medium moving along a path through a print zone, comprising:

a printhead, adapted to deposit ink on the recording medium;

a segmented flexible heater, disposed adjacently to the path, for heating the recording medium, including a first portion defining a first heat region preheating the recording medium and a second portion defining a second heat region heating the recording medium in the print zone;

a heater support, supporting said segmented flexible heater adjacently to the path, including a first support member and a second support member, said first support member being spaced a distance from said second support member, said first support member and said second support member contacting said segmented flexible heater wherein a section of said segmented flexible heater, located between said first support member and said second support member, is in non-contacting relation with said heater support; and a tensioning member, coupled to said segmented flexible heater, placing said segmented flexible heater in tension across said heater support.

15. The printing machine of claim 14, wherein said section is aligned with the print zone.

* * * * *